US006763939B2

(12) United States Patent
Alticosalian

(10) Patent No.: US 6,763,939 B2
(45) Date of Patent: Jul. 20, 2004

(54) DEVICE FOR STORING AND RELEASING A SUBSTANCE

(76) Inventor: Gerald Hagop Alticosalian, 27 Beaufort Road, Ealing, London (GB), W8 3EB ( * ) Notice: Subject to any disclaimer, the term of this patent is extended or adjusted under 35 U.S.C. 154(b) by 29 days.

(21) Appl. No.: 10/034,269

(22) Filed: Dec. 28, 2001

(65) Prior Publication Data

US 2002/0053524 A1 May 9, 2002

Related U.S. Application Data

(63) Continuation of application No. PCT/GB01/01891, filed on Apr. 27, 2001.

(30) Foreign Application Priority Data

Apr. 28, 2000 (GB) ..... 0010436

(51) Int. Cl.[7] ..... B65D 25/08
(52) U.S. Cl. ..... 206/222; 206/219
(58) Field of Search ..... 206/219, 222; 215/220, DIG. 8; 222/80, 94, 145.5, 145.1, 185.1

(56) References Cited

U.S. PATENT DOCUMENTS 4,773,529 A * 9/1988 Finke et al. ..... 215/DIG. 8
4,962,852 A * 10/1990 Affaitati et al. ..... 206/222
5,772,017 A 6/1998 Kang ..... 206/222
5,967,309 A 10/1999 Robles-Gonzalez et al. ..... 206/221

FOREIGN PATENT DOCUMENTS

| | | |
|---|---|---|
| DE | 6922863 | 6/1969 |
| DE | 44 10 323 A1 | of 1995 |
| FR | 2 729 372 | of 1995 |
| JP | 10273161 | of 1998 |

* cited by examiner

*Primary Examiner*—David T. Fidei
(74) *Attorney, Agent, or Firm*—St. Onge Steward Johnston & Reens LLC

(57) ABSTRACT

A cap is provided for storing powder and releasing it into a bottle. The cap comprises a cap top and an inner cap member which fits partially within the cap top to form a closed cavity for storing the powder and the cap is secured over the neck of the bottle. In use, the cap is rotated in an anticlockwise direction so that the cap top is rotated and raised relative to the inner cap member so as to open the cavity, releasing the powder stored therein into the bottle via the neck. The cap top is then further rotated in the anticlockwise direction so as to also rotate the inner cap member in the same direction, freeing the cap from the bottle.

8 Claims, 12 Drawing Sheets

DEVICE FOR STORING AND RELEASING A SUBSTANCE

This application is a continuation of pending International Application PCT/GB01/01891 filed on Apr. 27, 2001, which designates the United States and claims priority from British Application 0010436.4 filed on Apr. 28, 2000.

The present invention relates to a device for storing and releasing a substance and, more particularly though not exclusively, a soluble drug.

People often take soluble drugs whereby the drug, which may be in the form of a tablet or powder, is dissolved in a liquid, such as water, before being consumed. Such a soluble drug may be taken, for example, to relieve indigestion. If a person requires such a drug he must purchase it and then get a container and fill it with water to dissolve the drug in. Also, the drug may require a particular amount of water for it to dissolve to the correct concentration.

Another example of a soluble drug is one which comprises salts for adding to a drink so as to replace lost salts in the body, particularly in hot climates. However, drinks in which such salts have been added need to be kept refrigerated in order for them to be stored for any length of time.

Sometimes, a powder may be added to a drink to make it fizz. Once the powder is added to the drink the drink remains fizzy for a relatively short period of time. Thus, the powder must only be added to the drink shortly beforehand.

It is an object of the present invention to provide a device for storing and releasing a substance such as a soluble drug, which is simple and easy to use, to enable the substance to be dissolved or mixed with a suitable liquid prior to consumption.

To this end, one aspect of the present invention consists in a device for storing and releasing a substance, comprising:

- first and second parts which interengage to form a closed cavity for storing the substance;
- means for securing the interengaged parts over an opening of a container;
- means for enabling movement of the first part in one direction relative to the second part so as to open the cavity such that, when the parts are secured on the container, the substance is released from the cavity into the container via the container opening; and
- means for enabling further movement of the first part in said one direction so as also to move the second part in the same direction when the parts are secured on the container so as to remove the device from the container.

The means for enabling relative movement may be adapted to provide relative movement of the interengaged parts away from each other in order to open the cavity.

The means for enabling relative movement may be adapted to open the cavity by the first part causing a portion of the second part to at least partially disconnect from the remaining portion of the second part so as to open the cavity.

The two parts may comprise an inner part provided with the means for securing the interengaged parts to the container opening and an outer part arranged to engage said inner part.

The inner part may have one or more apertures formed therein through which the substance stored in the cavity is released. The outer part may be provided with means for plugging the aperture or apertures so as to close the cavity, movement of the outer part away from the inner part causing the plugging means to move out of the aperture or apertures and open the cavity.

One of the parts may have a storage means for storing the substance and the other part may have means for closing the storage means, the storage means and closing means adapted to substantially enclose the cavity, relative movement of the outer and inner parts away from each other causing the closing means to release the substance from the storage means.

The outer and inner parts may have interengaging means, whereby relative rotation in one direction of the outer and inner parts with the interengaging means engaged moves the outer and inner parts away from each other. The interengaging means may comprise a protrusion on one of the parts and a guiding channel for guiding the protrusion on the other part, the protrusion and channel adapted to interengage.

The inner part may have dispersal means adapted to disperse a substance stored in the cavity by the outer and inner parts being moved towards each other. The dispersal means may comprise a protrusion which is adapted to protrude into the cavity. The protrusion may be a cone.

The outer part may be provided with means for causing a portion of the inner part to disconnect from a remaining portion of the inner part. The disconnecting means may cut or shear a portion of the inner part.

It may be desirable for the outer part to be adapted to close the container opening.

The device may be provided with frangible tamper indicating means which is adapted to be broken to enable the device to be removed from the container.

The device may have means for sealably storing the substance.

The device may be arranged to close an aperture of the container.

According to another aspect of the invention there is provided a device for storing and releasing a substance, comprising:

- first and second parts which interengage to form a closed cavity for storing the substance;
- means for securing the interengaged parts over an opening of a container; and
- means for providing relative movement of the interengaged parts away from each other so as to open the cavity such that, when the parts are secured on the container, the substance is released from the cavity into the container via the container opening.

According to yet another aspect of the invention there is provided a method for releasing a substance stored in a device secured over an opening of a container, the device having an outer part and an inner part interengaged to retain the substance, comprising the steps of:

- moving the outer part in one direction relative to the inner part thereby releasing the substance into the container; and
- moving the outer part further in said one direction so as also to move the inner part in said one direction and thereby remove the device from the container.

The device may be provided with frangible means to prevent the substance from being released until required. The frangible means may be broken by initially moving the device in said one direction relative to the container so as to free the outer part from the inner part.

Embodiments of the present invention will now be described, by way of example, with reference to the accompanying drawings, in which.

Figure 1:
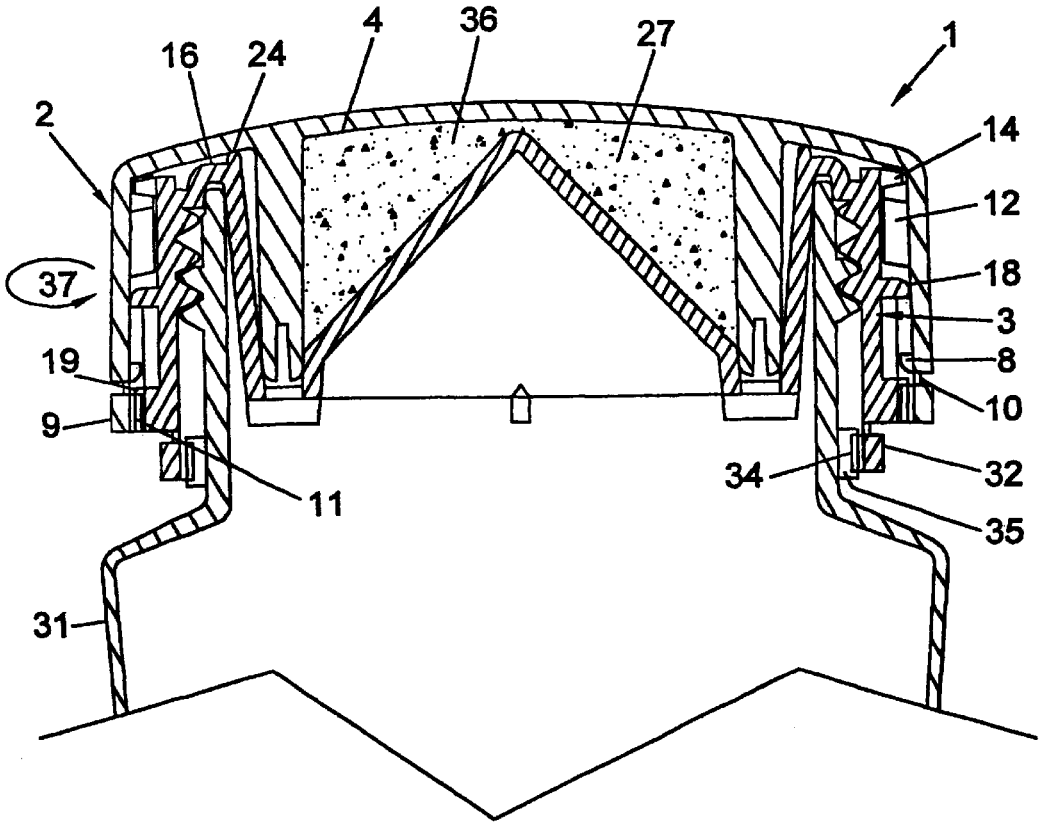
FIG. 1 is a cross-sectional view of a device in accordance with a first embodiment of the invention connected to a container.

Referring to FIG. 1 of the accompanying drawings, a device or cap 1 for a container, preferably a bottle, comprises an outer part or cylindrical cap top 2 and an inner part or cylindrical inner cap member 3, the cap member 3 fitting partially within the cap top 2.

Figure 2:
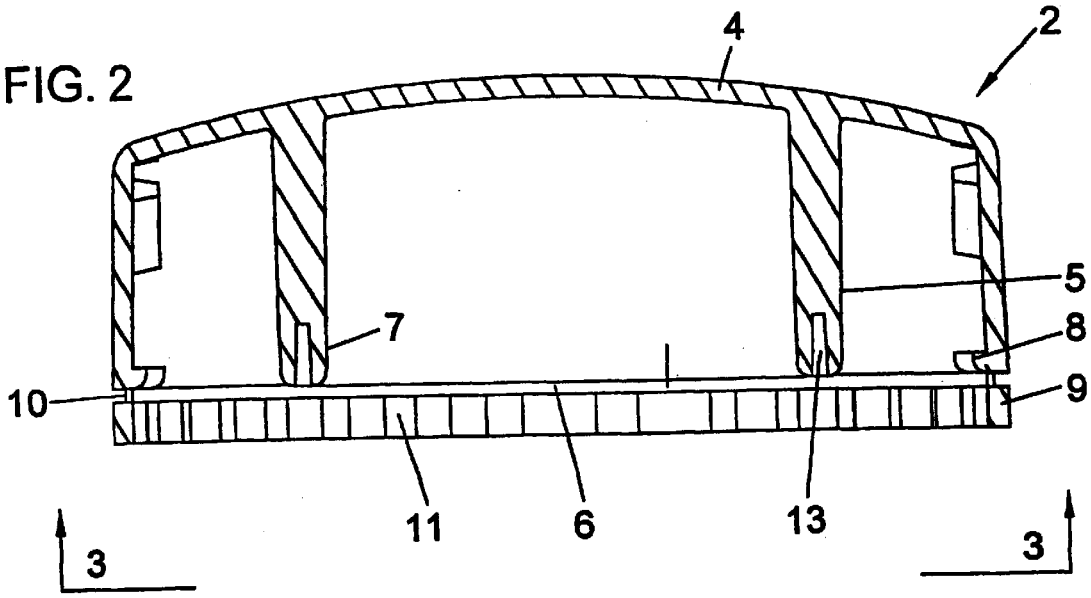
FIG. 2 is a cross-sectional view of an outer part of the device.
Figure 3:
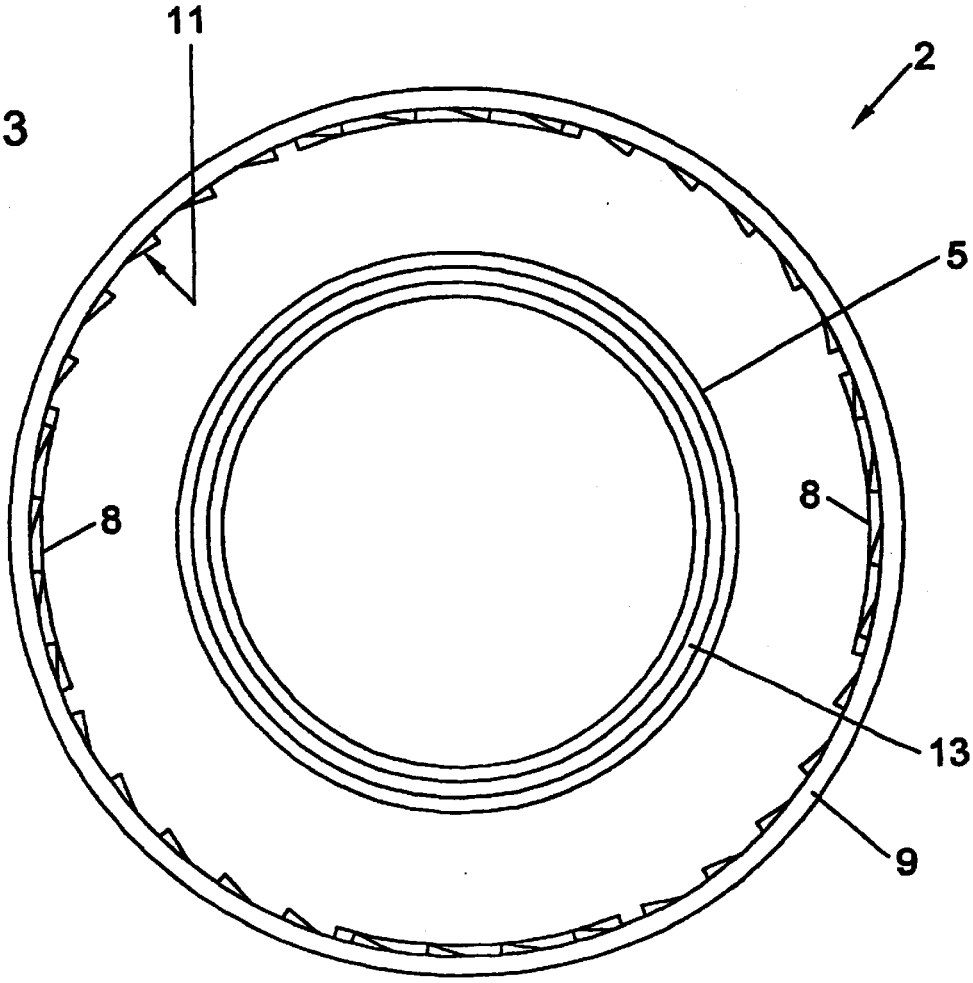
FIG. 3 is a view taken along lines 3—3 of FIG. 2.

Referring to FIGS. 2 and 3, the cap top 2 has an open end 6 and an opposite closed end 4 from which a centrally located cylinder 5 protrudes into the cap top 2. The distal end portion 7 of the wall of the cylinder 5 is tapered and may contain an annular slot 13. On the inside surface of the cap top 2 adjacent the open end 6 are a series of protrusions 8 forming an intermittent annular flange. Below the open end 6 is a ring 9 of substantially the same diameter as the cap top 2, the ring being connected to the cap top by a plurality of spaced apart frangible shear pins 10. The inside of the ring has a series of latching serrations 11.

Figure 4:
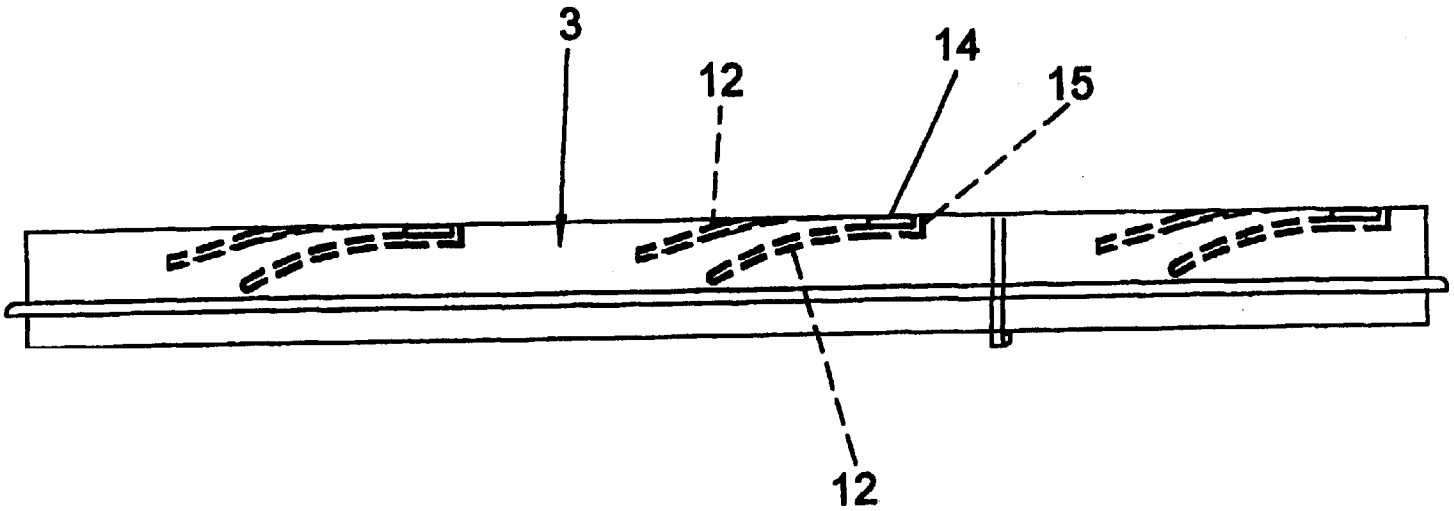
FIG. 4 is a view of part of the outside surface of an inner part of the device.
Figure 5:
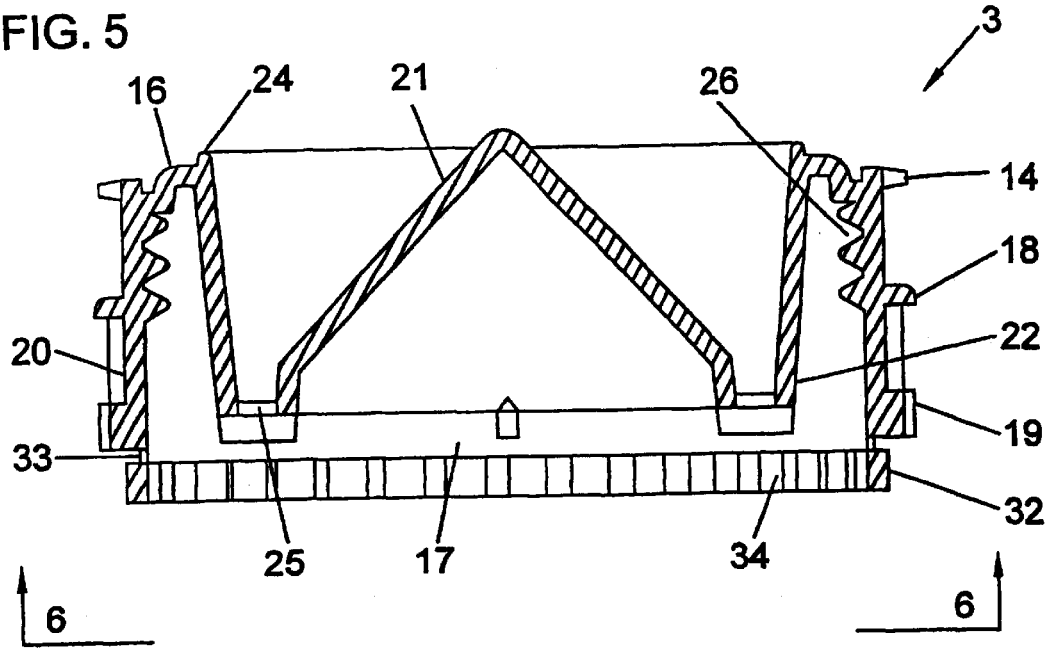
FIG. 5 is a cross-sectional view of the inner part.
Figure 6:
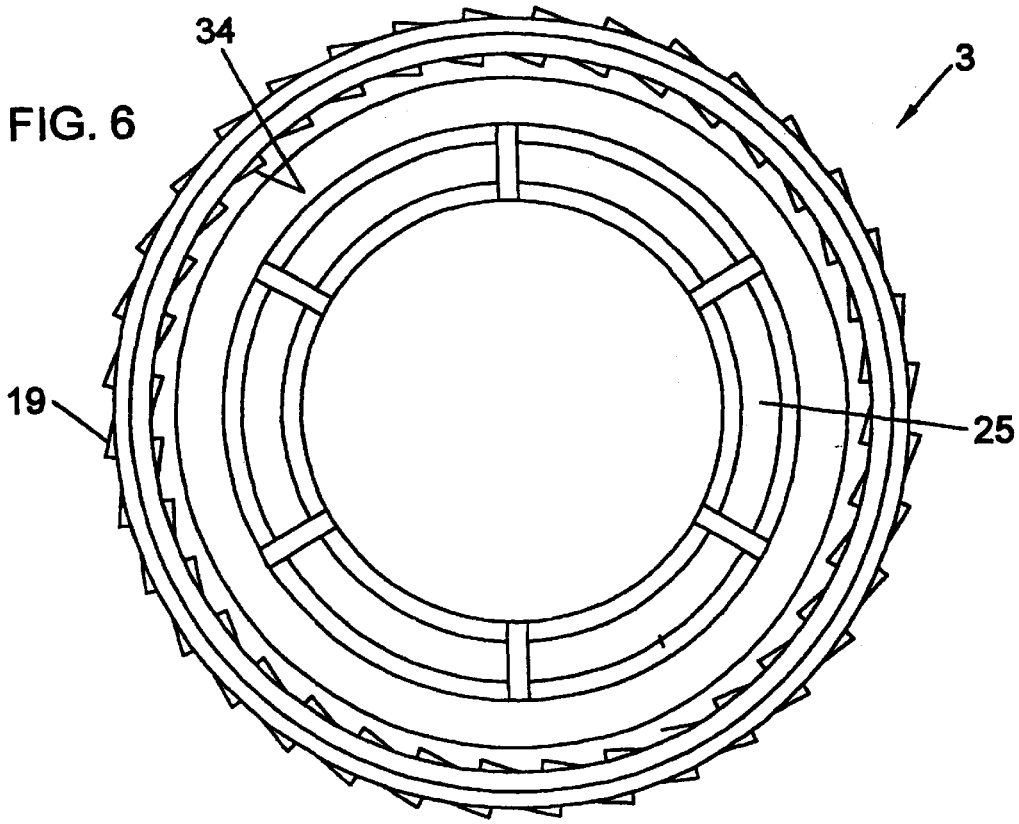
FIG. 6 is a view taken along lines 6—6 of FIG. 5.

The cap top 2 also has an inside surface on which there are pairs of cam threads 12 (shown in dashed lines on FIG. 4) forming guide channels for engaging and guiding respective protrusions 14 on an outside surface of the inner cap member 3 as illustrated in FIGS. 4 to 6. Each pair of cam threads 12 ends in the vicinity of a substantially closed end 16 of the inner cap member, the opposite end 17 of the cap member 3 being open and one of the pair of cam threads has a stop 15 in the vicinity of the closed end.

The outside surface of the inner cap member 3 has an annular flange 18 below the protrusions 14 and there is a series of latching serrations 19 on the outside surface adjacent the open end 17 of the cylinder.

The substantially closed end 16 of cylindrical inner cap member 3 has a hollow frusto-cone 20 extending into the cap member 3 with a cone 21 extending in the opposite direction from the tapered end 22 of the frusto-cone 20. Between the tapered end 22 of the frusto-cone 20 and the base of the cone 21 there are a plurality of spaced apart apertures 25.

Figure 7:
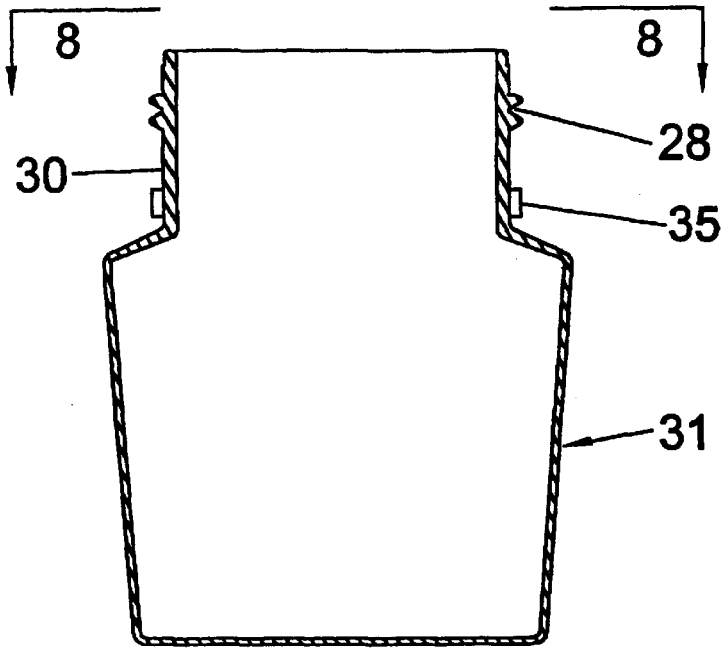
FIGS. 7 and 8 are a cross-sectional view and a plan view respectively of the container.
Figure 8:
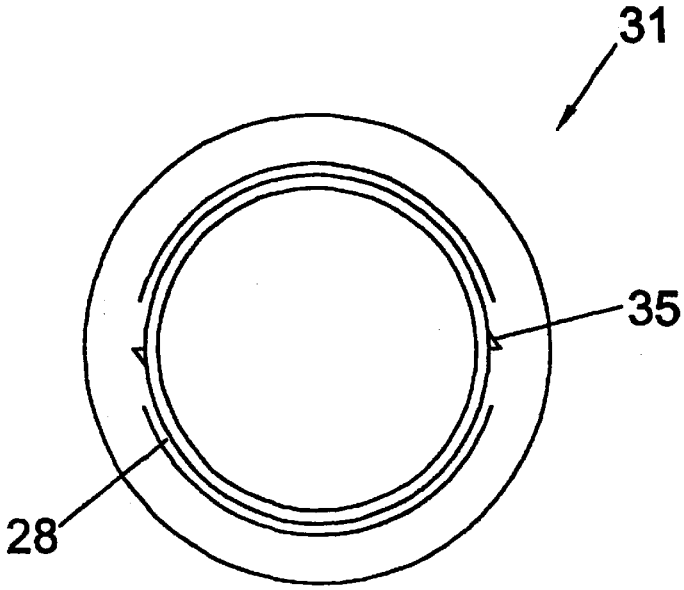

The inner cap member 3 also has an internal screw thread 26 on its inside surface for engaging an external screw thread 28 on an outside surface of the neck 30 of the bottle 31 as illustrated in FIGS. 7 and 8.

Below the open end 17 of the cylindrical inner cap member 3 is a ring 32 of substantially the same diameter as the cap member 3 connected to the cap member by a plurality of spaced apart frangible shear pins 33 which are stronger than the frangible shear pins 10 of the cap top 2. The inside of the ring 32 has a series of latching serrations 34 for interacting with a pair of latches 35 on the opposite sides of the outside surface of the neck 30 of the bottle 31.

The latches 35 have an inclined side for engaging serrations 34 so that the latches and serrations can be forced past each other when they are relatively rotated in one direction, with the latches and serrations opposing relative rotation in the opposite direction. Similarly the serrations 11,19 can be forced past each other when they are relatively rotated in one direction, with the serrations 11,19 opposing relative rotation in the opposite direction. Also, the annular flange 18 and the flange protrusions 8 are shaped so that they can be forced past each other in one direction but oppose each other in the opposite direction.

The method of constructing the cap 1 and placing it on the bottle 31 will now be described.

The cap top 2 is placed upside down. A powder, such as a soluble drug powder for relieving indigestion is then added to the inside of the cylinder 5. The cylinder 5 is used to form a cavity and acts as a storage means for the powder.

The inner cap member 3 is also put in an upside down position and placed partially inside the cap top 2 so that the inner cap member's protrusions 14 are engaged by the cap top's cam threads 12 and so that the annular flange 18 of the cap member 3 is forced past the serrations 11 of the ring 9 of the cap top 2. The inner cap member 3 is then rotated relative to the cap top 2 so that the former is partially retracted into the latter. This causes the cone 21 to be moved in a downward direction dispersing the powder. The inner cap member 3 is rotated causing the annular flange 18 to be forced past the flange protrusions 8 of the cap top 2 and is rotated until the protrusions 14 are stopped by the guide channel stops 15. At the end of this rotation process the latching serrations 19 of the inner cap member 3 engage the serrations 11 of the ring 9 of the cap top 2 (see FIG. 1) fixing the cap top 2 and the cap member 3 together. When this rotation process is completed the distal tapered end 7 of the storage cylinder 5 plugs the apertures 25 at the tapered end 22 of the frusto-cone 20 and the inner cap member 3 closes the open end of the cylinder 5 sealing the powder 36 (see FIG. 1) stored in the cap top 2 in a cavity 27. The distal end 7 seals the stored powder 36 with the annular slot 13 in the distal end 7 of the cylinder wall providing some give. The inside surface of the closed end 4 of the cap top 2 is forced against an annular protrusion 24 on the closed end of the inner cap member 3 forming a stop and secondary seal.

Figure 9:
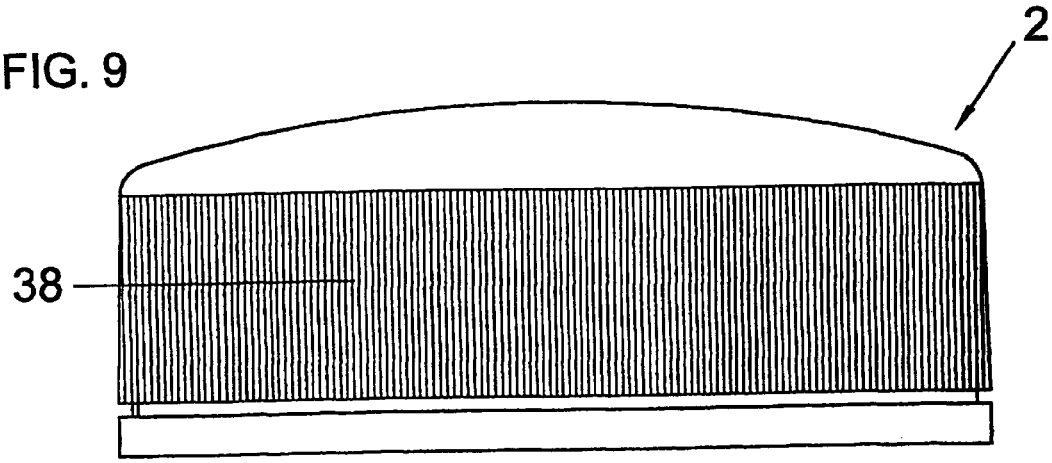
FIG. 9 is a side elevational view of the outer part of the device.

Water, or some other suitable liquid, is put into the bottle 31. The cap 1 is turned so as to be the right way up (see FIG. 9) and is placed so that the inner cap member's internal screw thread 26 is engaged by the bottle's external screw thread 28. The cap 1 is then screwed onto the bottle 31. When the cap 1 cannot be screwed any further the serrations 34 of the ring 32 of the inner cap member 3 engage the latches 35 of the bottle 31 (see FIG. 1) securing the cap to the neck 30 of the bottle. The ring 32 and shear pins 33 comprise at least part of frangible tamper indicating means known as a "tamper evident seal".

Figure 10:
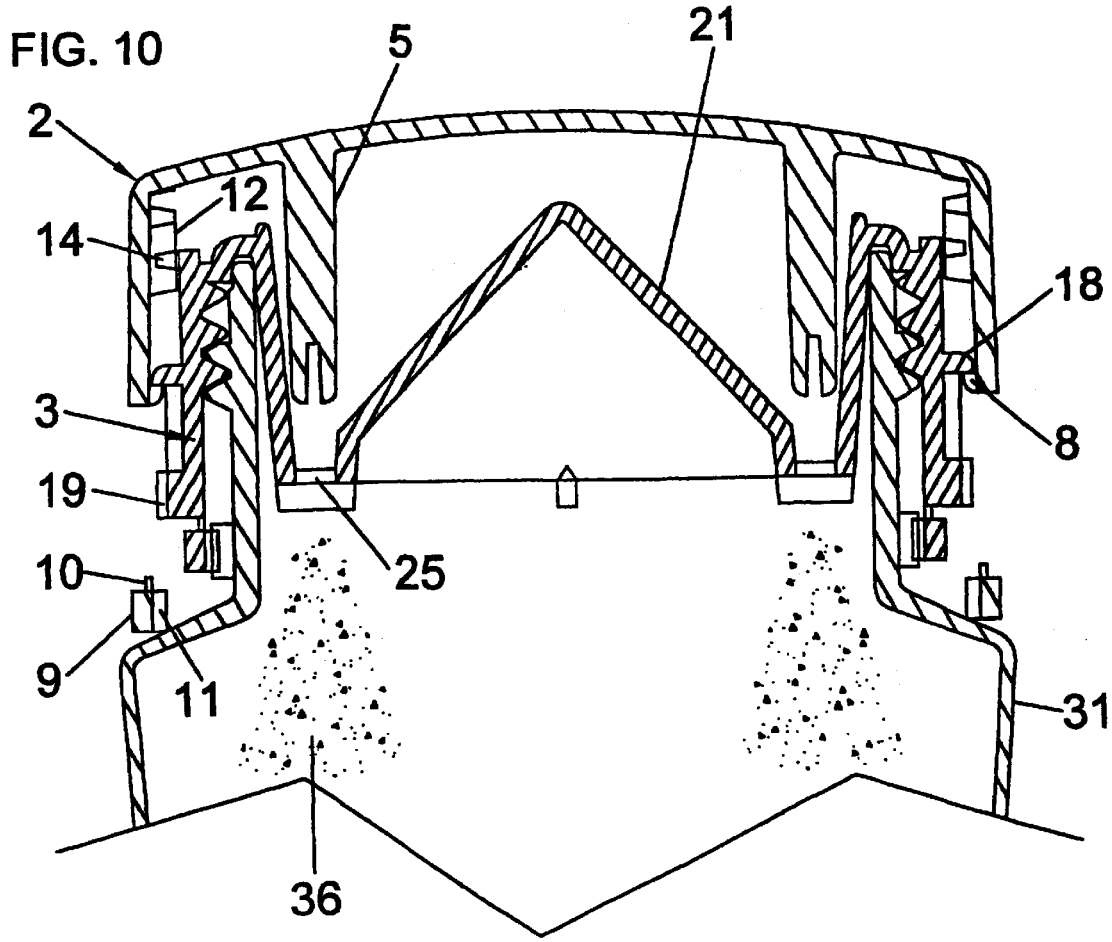
FIG. 10 is a cross-sectional view of the device in use.

In use, the cap 1 is rotated in an anti-clockwise direction, as indicated by arrow 37, the cap top 2 having grips 38 (see FIG. 9) on its outside surface to aid a user in rotating the cap 1. The cap member's latching serrations 19 oppose the rotation of the serrations 11 of the ring 9 of the cap top 2 and the rotation thus causes the cap top's shear pins 10 to shear, freeing the cap top 2 from the inner cap member 3. The inner cap member's protrusions 14 are engaged by the cam threads 12 so that continued rotation in the anti-clockwise direction causes the cap top 2 to be raised relative to the inner cap member 3. The continued rotation also has the effect of the storage cylinder 5 being raised from the cone 21, raising the tapered distal end 7 of the cylinder so as to unplug the apertures 25 at the tapered end 22 of the frusto-cone 20. Thus, the powder 36 is released from the cylinder 5, as shown in FIG. 10, and falls into the water in the bottle 31 below where it dissolves. The cone 21, by nature of its shapes, enables substantially all the powder stored in the storage cylinder 5 above to be released and evenly distributed into the water in the bottle. The earlier dispersal of the powder also causes the powder to be evenly distributed.

The cap top 2 is rotated in the same direction until the flange protrusions 8 of the cap top 2 are opposed by the annular flange 18 of the inner cap member 3 preventing any further relative rotation between former and the latter. Further rotation of the cap top 2 in the same direction causes the shear pins 33 of the inner cap member 3 to shear, freeing the cap 1 from the bottle 31 so that the cap can be removed from the bottle and the water containing the dissolved powder can then be drunk. The cap 1 and bottle 31 are designed to be disposed of after use.

Figure 11:
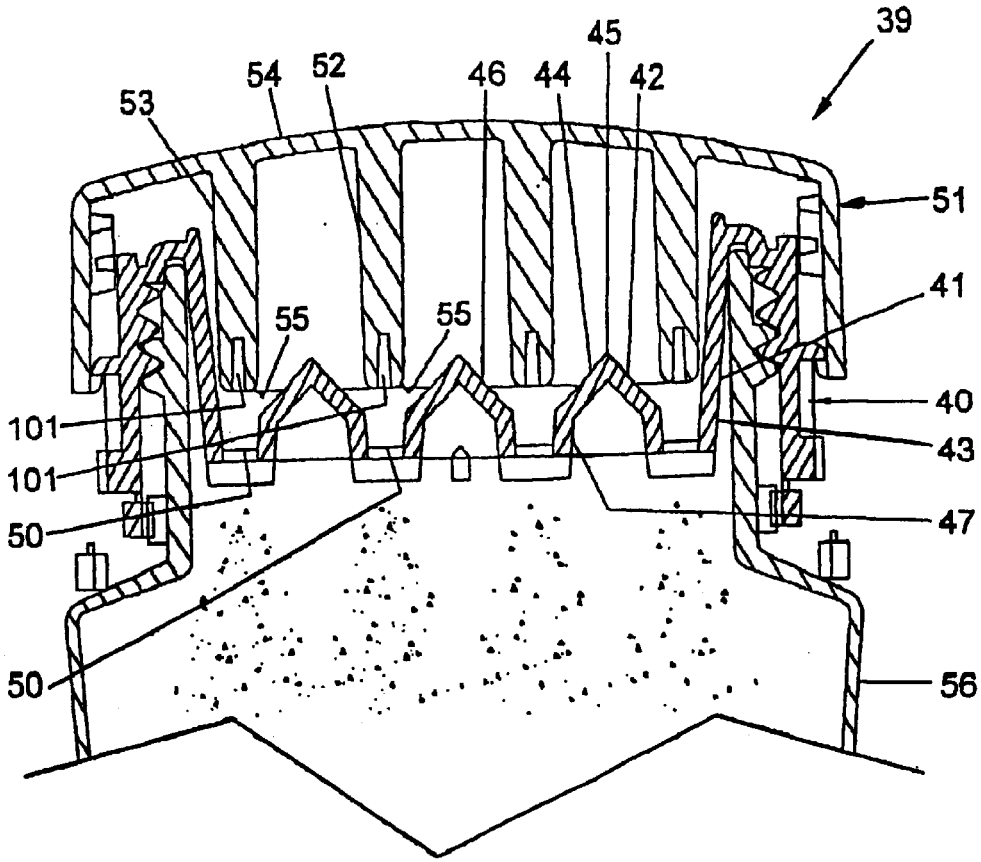
FIG. 11 is a cross-sectional view of a device, in accordance with a second embodiment of the invention, in use.
Figure 12:
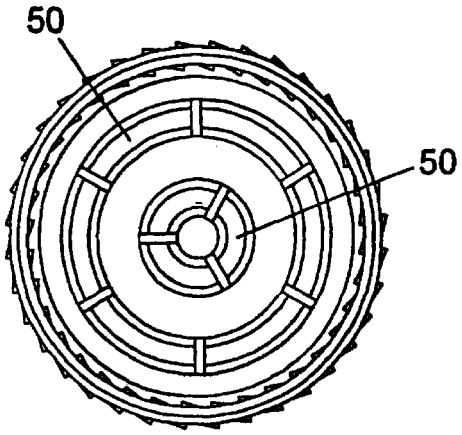
FIG. 12 is a view, similar to FIG. 6, of an inner part of the device of FIG. 11.

In a second embodiment, as shown in FIGS. 11 and 12, the cylindrical inner cap and the cap top of the device 39 or cap have been modified in the following way. The cylindrical inner cap member 40 has a first hollow frusto-cone 41 extending into the inner cap member 40 with a second frusto-cone 42 extending in the opposite direction from the tapered end 43 of the first frusto-cone 41. A third frusto-cone 44 is provided which extends into the inner cap member 40 from the tapered end 45 of the second frusto-cone 42 and a cone 46 extends in the opposite direction to the tapered end 47 of the third frusto-cone 44. Between the tapered end 43 of the first frusto-cone 41 and the base of the second frusto-cone 42 and between the tapered end 47 of the third frusto-cone 44 and the base of the cone 46 there are a plurality of spaced apart apertures 50, the frusto-cones 42,44,46 having steeper slopes in the vicinity of the apertures.

The cap top 51 has two centrally located cylinders 52,53 of different dimensions extending from the closed end 54 of the cap top. The distal end portion 55 of the wall of each cylinder 52,53 is tapered on both its inside surface and its outside surface and may have an annular slot 101.

When powder is placed in the cap 39, the powder is placed inside both cylinders 52,53 and the inner cap member 40 is then rotated relative to the cap top 51, packing the powder until the distal tapered end 55 of the two cylinders 52,53 plugs the apertures 50.

Other parts of the embodiment shown in FIG. 11 correspond to parts of the first embodiment and are accordingly not described again.

In use, when the cap top 51 is rotated relative to the inner cap member 40, the distal tapered ends 55 of the two cylinders are raised so as to unplug the apertures releasing the powder into the bottle 56.

Figure 13:
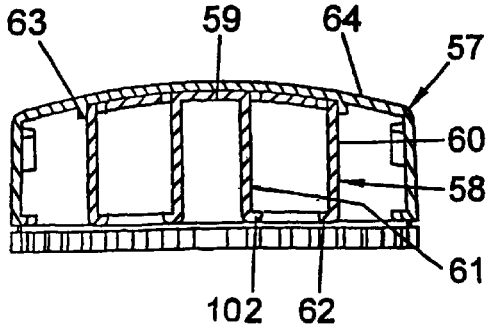
FIG. 13 is a cross-sectional view of an outer part of a device in accordance with a third embodiment of the invention.
Figure 14:
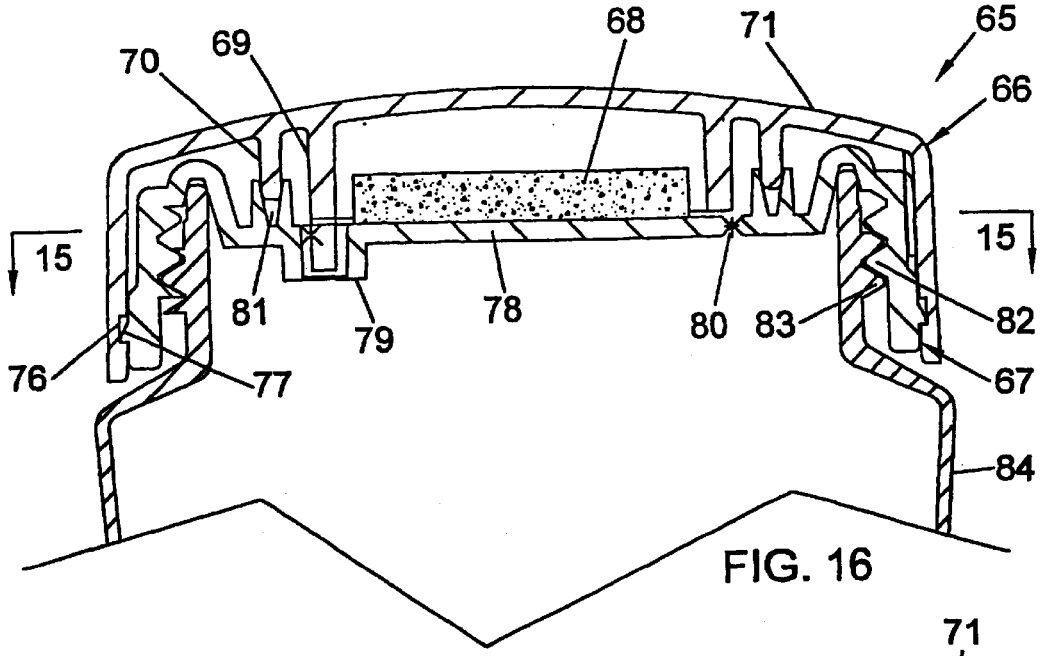
FIG. 14 is a cross-sectional view of a device in accordance with a fourth embodiment of the invention connected to a container.
Figure 16:
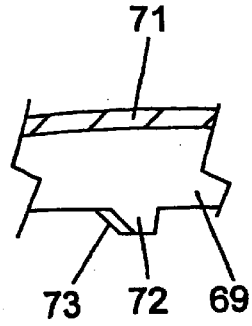
FIG. 16 is a detail of a portion of an outer part of the device shown in FIG. 14.
Figure 15:
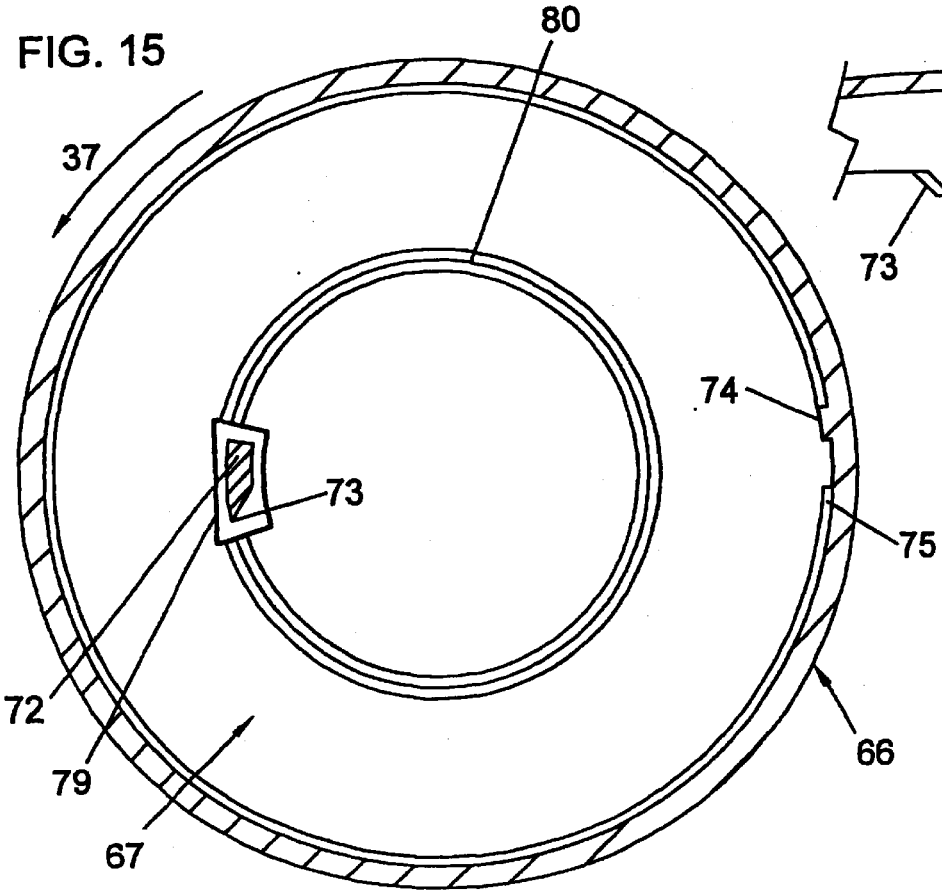
FIG. 15 is a view taken along lines 15—15 of FIG. 14.

In a third embodiment as shown in FIG. 13, the inner part or cap top has been modified from that shown in the second embodiment in the following way. The cap top 57 includes a component 58 comprising a circular base 59 from which two centrally located cylinders 60,61 of different diameters extend. The distal end of the outer cylinder 60 has an inwardly directed lip 62 and the distal end of the inner cylinder 61 has a corresponding outwardly directed lip 102. These lips have been provided so that they are wide enough to plug the apertures in the inner cap member. The component 58 fits inside a centrally located annular protrusion 63 extending from the closed end 64 of the cap top 57 with the base 59 of the component 58 being adjacent the closed end 64 of the cap top 57. The third embodiment facilitates moulding of the cap and provides uniform wall thickness for the cylinders 60,61.

In a fourth embodiment, as shown in FIGS. 14 to 18, the cap 65 again comprises a cap top 66 and a cylindrical inner cap member 67, wherein the cap is adapted to store and release a tablet 68 or tablets instead of powder.

The cap top 66 has two centrally located cylinders 69,70 of different diameters extending from its closed end 71 wherein a stub 72 with a cutting edge 73 protrudes from the distal end of the wall of the inner cylinder 69.

The cap top 66 also has an inside surface on which there is a protrusion 74 which is adapted to be received in a recess 75 in an outside surface of the inner cap member 67. The recess 75 extends for almost the whole circumference of the inner cap member 67. The cap top 66 also has an annular groove 76 on its inside surface which is adapted to receive a ring 77 protruding from the outside surface of the inner cap member 67 and form a snap lock connection.

The closed end 78 of the inner cap member 67 has a pocket 79 for receiving the stub 72 and a pair of centrally located annular grooves on opposite sides of the closed end forming a line of weakness 80 in the closed end 78, the pocket extending through the line of weakness. The closed end 78 of the inner cap member 67 also has an annular groove 81 defined by a pair of annular walls for receiving the distal end of the outer cylinder 70 of the cap top 66 to seal the tablet.

In a similar manner to the first embodiment, the inner cap member 67 has an internal screw thread 82 for engaging an external screw thread 83 on a bottle 84. The inner cap member 67 may have shear pins and a serrated ring (not shown) to engage the bottle like that described in the first embodiment.

To construct the cap 65, the cap top 66 is placed upside down and a tablet 68 is placed inside the inner cylinder 69. The inner cap member 67 is pushed inside the cap top 66 so that the stub 72 is received by the pocket 79, the ring 77 snaps into the annular groove 76 on the inside surface of the cap top 66, and the distal end of the outer cylinder 70 is received in the groove 81 of the inner cap member. The cap is then screwed onto a bottle 84.

Figure 17:
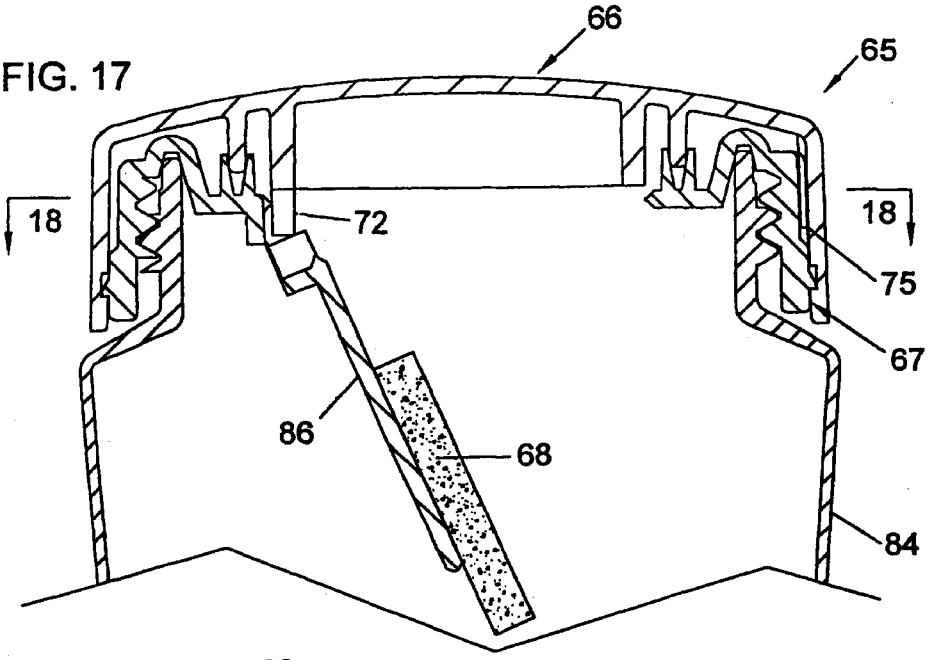
FIG. 17 is a view similar to FIG. 14 showing the device in use.
Figure 18:
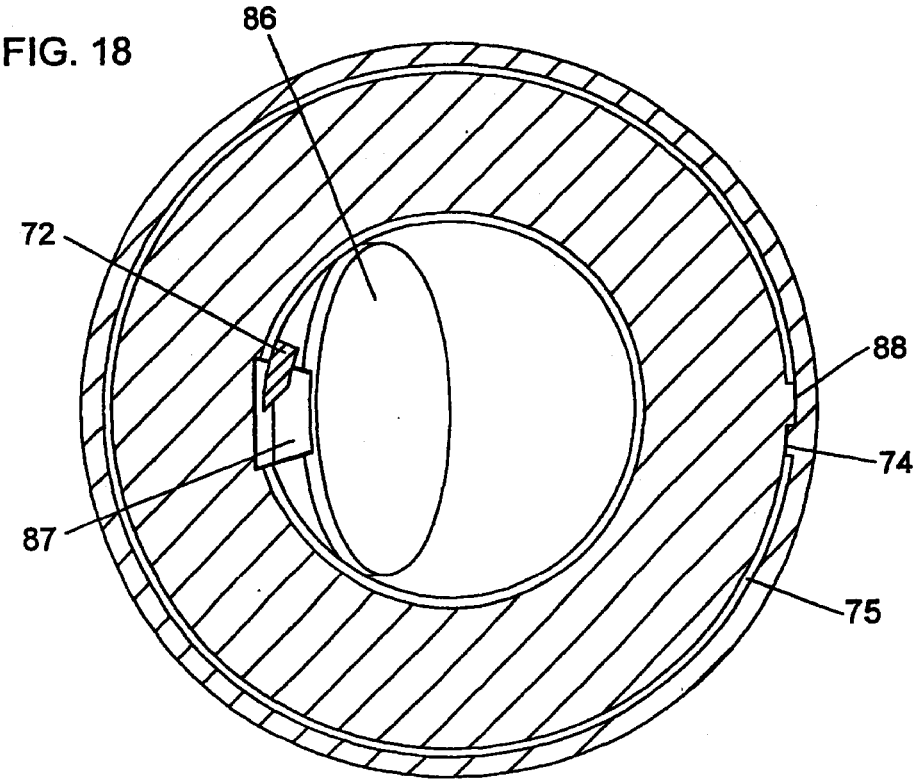
FIG. 18 is a view taken along lines 18—18 of FIG. 17.
Figure 19:
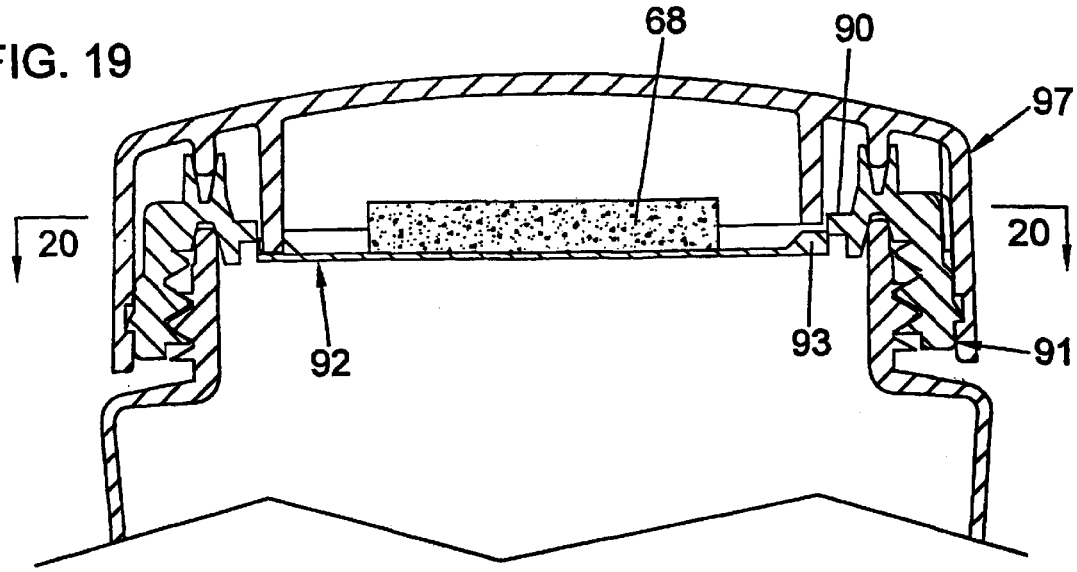
FIGS. 19 to 23 are views similar to FIGS. 14 to 18 respectively of a device in accordance with a fifth embodiment of the invention.
Figure 20:
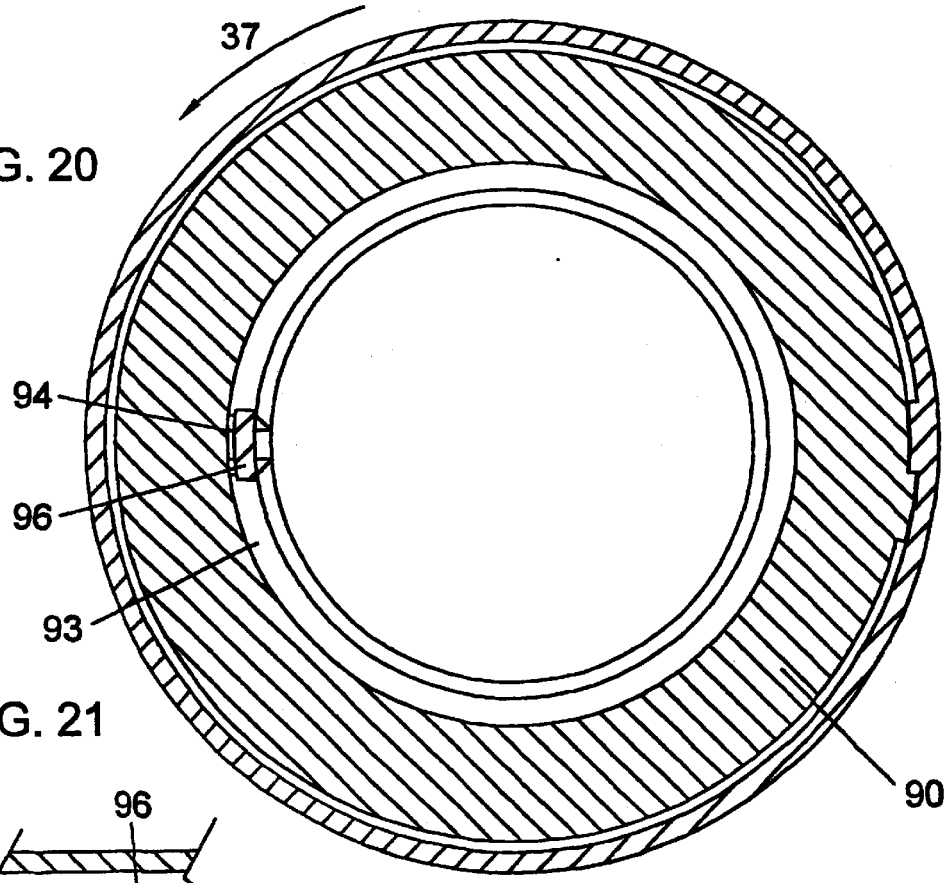
Figure 21:
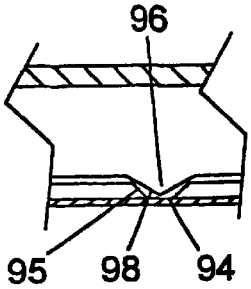

In use, the cap top 66 is rotated anti-clockwise relative to the inner cap member 67, as indicated by arrow 37, so that the cutting edge 73 of the stub 72 cuts the line of weakness 80 in the closed end 78 of the inner cap member 67. Referring to FIGS. 17 and 18 when the cap top 66 has been rotated through almost one revolution, the stub 72 causes a disc 86 to have been cut out of the closed end 78 except for a connection 87 at the pocket 73. This disc 86 swings about this connection 87, which acts as a hinge, into the inside of the bottle 84 releasing the tablet 68 into the bottle. Further rotation of the cap top relative to the inner cap member is resisted by the protrusion 74 being engaged by an end 88 of the recess 75. Thus, further rotation causes both the cap top 66 and the inner cap member 67 to rotate unscrewing the inner cap member 67 from the bottle 84 so that the cap 65 is removed from the bottle 84. The friction between the interengaging threads 82,83 of the inner cap member 67 and the bottle 84 prevents the inner cap member from being unscrewed from the bottle until after the cap top protrusion 74 has engaged the recess end 88 of the inner cap member 67.

In a fifth embodiment, as illustrated in FIGS. 19 to 23, the cap top and the inner cap member of the fourth embodiment have been modified in the following way. The closed end 90 of the inner cap member 91 has a centrally located disc 92, which is sunk into the inner cap member 91. The disc 92 has a rim 93, the outer edge of which is connected to the remaining portion of the closed end 90. The disc 92 is adapted to hold a tablet 68 within the rim 93. The rim 93 has a recess 94 (see FIG. 21) with an inclined side 95 radial to the disc 92 for receiving a stub 96 protruding from the inner cylinder of the cap top 97 wherein the stub 96 has a shearing edge 98 for engaging the inclined side 95 of the recess 94.

Other parts of the embodiment shown in FIGS. 19 to 23 correspond to parts of the fourth embodiment and are accordingly not described again.

Figure 22:
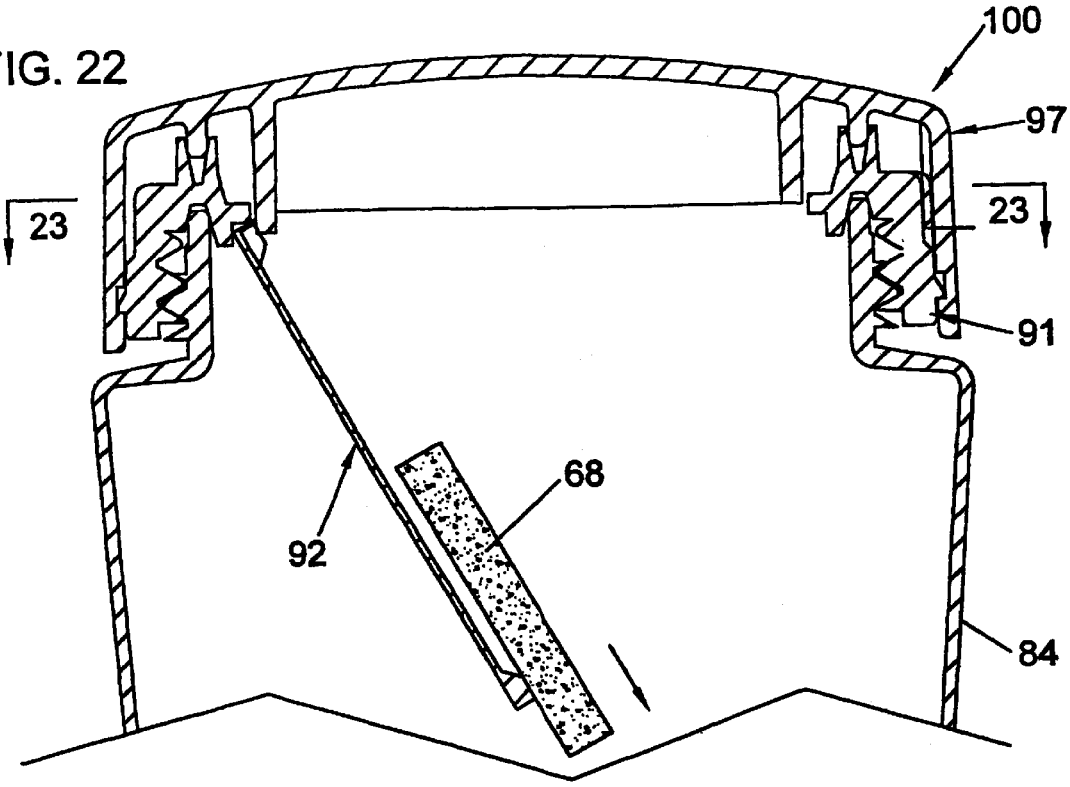
Figure 23:
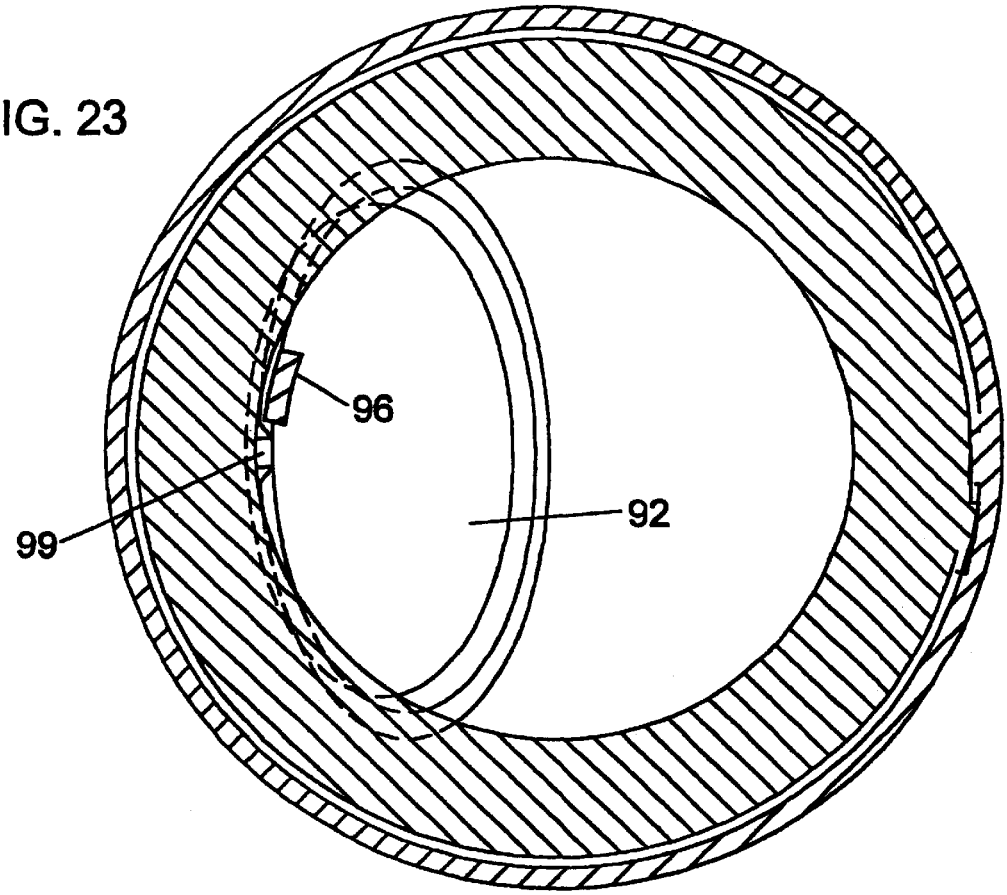

In use, the cap top 97 is rotated in an anti-clockwise direction relative to the inner cap member 91, as indicated by arrow 37, so that the shearing edge 98 engages the inclined side 95 of the recess pushing the rim 93 of the disc 92 down, shearing the rim 93 from the remaining portion of the closed end 90 of the inner cap member 91. When the cap top 97 has been rotated through almost one rotation, as shown in FIGS. 22 and 23, the disc 92 is almost completely sheared from the closed end 90 except for its connection 99 at the recess 94 about which it swings, releasing the tablet 68 into the bottle 84. Further rotation causes the cap 100 to be removed from the bottle 84 as previously described in the fourth embodiment.

The cap of the embodiments is preferably of a plastics material.

Whilst particular embodiments have been described, it will be understood that various modifications may be made without departing from the scope of the invention. For example, the cap may be designed to be opened by being twisted in a clockwise direction. Alternatively, the cap may be opened by linear movement, i.e. by pulling the cap top away from the inner cap member to open the cavity, releasing the substance stored therein, and then removing the cap from the container by further pulling in the same direction.

The powder or tablet may be replaced by any other suitable form of substance such as granules such as salt, a gel or a liquid. The cap may store the substance in an air-tight environment. The bottle may be filled with the optimum amount of liquid for the powder or tablet to dissolve in.

The cap may be manufactured and filled with the substance in one location, the bottle may be manufactured in another location and the bottle may be filled with liquid and sealed with the cap in yet another location. By being able to do this, less specialized machines are required for the production of a cap storing a substance fitted onto a bottle filled with liquid. Thus, there are cost savings.

The frangible tamper indicating means of the first embodiment between the inner cap member and the bottle is optional. Other forms of frangible tamper indicating means may be used such as conventional "shrink wrap seals". Frangible tamper indicating means may be provided for the fourth and fifth embodiments.

The interengaging protrusions of the inner cap member and the guiding channels of the cap top of the first and second embodiments may be replaced by screw threads adapted to threadably interengage.

The wall of the storage cylinder(s) in the cap top of the first and second embodiments may be tapered on both its inside surface and its outside surface from the base of the wall to its distal end. The cone and, where appropriate, the joined ends of two frusto-cones which protrude into the storage cylinder(s) may be replaced by a structure of any suitable shape which enables the powder stored in the storage cylinder(s) above to be released and evenly distributed into the liquid in the bottle.

What is claimed is:

1. A device for storing and releasing a substance, comprising outer and inner parts which interengage to form a closed cavity for storing the substance;

means for securing the interengaged parts over an opening of a container;

means for cutting or shearing a portion of the inner part from a remaining portion of the inner part so as to open the cavity;

means for enabling movement of the outer part in one direction relative to the inner part whilst the interengaged parts are secured on the container, said movement causing said cutting or shearing means to open the cavity and release the substance into the container via the container opening; and means for enabling further movement of the outer part in said one direction so as also to move the inner part in the same direction and thereby remove the interengaged parts from the container.

2. A device as claimed in claim 1, wherein the inner part is provided with the means for securing the interengaged parts to the container opening.

3. A device as claimed in claim 1, wherein the outer part is adapted to close the container opening.

4. A device as claimed in claim 1, further comprising frangible tamper indicating means adapted to be broken to enable the device to be removed from the container.

5. A device as claimed in claim 1, including means for sealably storing the substance.

6. A device as claimed in claim 1, further comprising a container having an aperture, said device being sized and located to close said aperture of the container.

7. A device as claimed in claim 5, wherein said outer part has a closed end and a cylinder extending from the closed end, said cylinder is centrally located on the closed end and has a distal end, and said inner part has a closed end and the closed end has a pair of annular walls defining an annular groove for receiving said distal end of said cylinder.

8. A container for retaining a liquid and having an opening, and a device adapted to close said opening and for storing and releasing a substance, said device comprising outer and inner parts which interengage to form a closed cavity for storing the substance;

means for securing the interengaged parts over the opening of said container;

means for cutting or shearing a portion of the inner part from a remaining portion of the inner part so as to open the cavity;

means for enabling movement of the outer part in one direction relative to the inner part whilst the interengaged parts are secured on the container, said movement causing said cutting or shearing means to open the cavity and release the substance into the container via the container opening; and means for enabling further movement of the outer part in said one direction so as also to move the inner part in the same direction and thereby remove the interengaged parts from the container.

* * * * *